US009126124B2

(12) United States Patent
Carleo

(10) Patent No.: US 9,126,124 B2
(45) Date of Patent: Sep. 8, 2015

(54) MULTIDIRECTIONAL SENSORY ARRAY

(71) Applicant: Giancarlo A. Carleo, Dallas, TX (US)

(72) Inventor: Giancarlo A. Carleo, Dallas, TX (US)

( * ) Notice: Subject to any disclaimer, the term of this patent is extended or adjusted under 35 U.S.C. 154(b) by 47 days.

(21) Appl. No.: 13/839,009

(22) Filed: Mar. 15, 2013

(65) Prior Publication Data

US 2014/0274428 A1 Sep. 18, 2014

(51) Int. Cl.
*A63J 21/00* (2006.01)
*A63J 25/00* (2009.01)

(52) U.S. Cl.
CPC ..... *A63J 25/00* (2013.01)

(58) Field of Classification Search
CPC ..... G03B 21/14; G03B 21/56; G03B 21/60; G02B 26/08; G02B 27/22; A63J 21/00; A63H 33/22; A63H 37/00
USPC ..... 472/57, 60, 61, 75, 80, 136, 64; 359/444, 445, 451, 454, 458, 459, 462
See application file for complete search history.

(56) References Cited

U.S. PATENT DOCUMENTS 2,369,340 A * 2/1945 Ditty et al. ..... 52/7
2,846,221 A * 8/1958 Skinner ..... 472/75
2,905,049 A 9/1959 Laube
4,512,117 A * 4/1985 Lange ..... 52/6
4,629,604 A 12/1986 Spector
4,640,266 A 2/1987 Levy
4,962,687 A 10/1990 Belliveau et al.
5,205,101 A * 4/1993 Swan et al. ..... 52/650.1
5,754,663 A 5/1998 Goldfarb
5,850,457 A 12/1998 Gefvert
6,169,595 B1 1/2001 Manne
6,695,985 B2 * 2/2004 Igarashi et al. ..... 252/518.1
6,702,767 B1 3/2004 Douglas et al.
6,865,023 B2 * 3/2005 Shafer ..... 359/445
7,746,002 B2 6/2010 Van Meurs et al.
8,299,903 B2 10/2012 Haase et al.
8,300,869 B2 10/2012 Marlin et al.
8,363,865 B1 1/2013 Bottum
2005/0024488 A1 2/2005 Borg
2012/0250912 A1 10/2012 Chung

* cited by examiner

*Primary Examiner* — Kien Nguyen

(57) ABSTRACT

Apparatuses and methods for enhancing the multisensory experience of the members of the audience at entertainment venues are disclosed. The inventions disclosed herein permit an audience member to receive sensory stimulation of the senses of sound, sight, smell, touch, or taste through multisensory entertainment modules positioned on a structure so that each audience member is within a maximum optimal distance from one or more multisensory entertainment modules. An object of the inventions is to provide each attendee at an entertainment event with a multisensory experience of similar quality to that of every other attendee.

5 Claims, 3 Drawing Sheets

MULTIDIRECTIONAL SENSORY ARRAY

FIELD OF THE INVENTION

The present invention relates generally to enhancing the experience of the members of the audience at entertainment events through the stimulation of a plurality of the senses of sight, sound, touch, taste and smell.

BACKGROUND OF THE INVENTION

The prior art is replete with different concert hall designs and designs related to staging for entertainment venues. For example, U.S. Pat. No. 5,323,564 relates to a performance stage deck and assembly method. Similarly, U.S. Pat. No. 4,409,762 relates to a road structure for telescoping seating systems and methods of assembly the same. These patents and many others like them are typically directed to solving problems related to transportability of a stage and/or the ability to direct light or sound from the stage towards the audience. Additionally, the prior art also is replete with inventions that focus on delivering a multisensory experience to an individual in an enclosure. For example, U.S. Pat. No. 6,702,767 relates to a multisensory stimulation system wherein an individual is seated in a viewing chamber that provides stimulation through an optical system as well as aromatic sensory components, tactile sensation devices, an audio input system, and an audio delivery device. The focus of these inventions is generally providing an individual with a multi-sensory stimulation experience for the purpose of stress relief. Other inventions relate the distribution of fragrance throughout a building or a room, such as a theater, for the purpose of masking foul odors.

The prior art, however, lacks inventions directed to enhancement of the experience of the audience at entertainment venues through multisensory stimulation of the senses of sight, sound, taste, touch and smell. As such, the experience of an audience member in an entertainment venue who sits closer to the stage is generally quite different than the experience of an audience member who sits farther away from the stage. For example when fragrance intended to be incorporated into a performance, the audience members sitting closer to the stage are more likely to experience stimulation of their senses of smell when fragrance emitters are located near the stage. Similarly, when pyrotechnics are incorporated as part of a performance, those seated closer to the stage will have a better view of the pyrotechnics than those seated farther away from the stage. Additionally, those seated closer to the stage will generally receive greater stimulation of their senses of sound than those seated farther from the stage when the speakers or sound reproduction system is located at or near the stage. Additionally, when taste stimulation is emitted from the stage, those seated close to the stage are more likely to be stimulated than those seated away from the stage. Also, when touch is stimulated by—for example—bubble or foam emission from the stage, those located near the stage are more likely to be stimulated.

SUMMARY OF THE INVENTION

This invention relates to enhancing the experience of the members of the audience at entertainment events through the stimulation of a plurality of the senses of sight, sound, touch, taste and smell. The invention is for the use in venues such as amphitheaters, concert halls, auditoriums, indoor and outdoor public presentation venues, convention centers, drive-in theaters and the like. An object of the invention is to enhance the stimulation of the audience at an entertainment venue so that, regardless of where an attendee is seated within a venue, his/her sensory experience will closely approximate the sensory experience of every other attendee.

In one embodiment, the invention incorporates a structure extending throughout the entertainment venue, which may or may not originate from ground level and extend above the audience. The structure may form a lattice around the audience. Furthermore, the structure is composed so that multisensory entertainment modules can be attached to the structure.

Each multisensory entertainment module—which is attachable to the structure—may include one or more speakers, lights, lasers, fog generators, foam generators, fragrance diffusers, taste diffusers, pyrotechnic devices or fireworks. The multisensory entertainment module may also include other sensory stimulating devices. The various sensory stimulating devices incorporated in each multisensory entertainment module are housed such that they may be attached and detached from the module so that a plurality of sensory stimulating devices may be included in the module in any combination. Accordingly, a speaker may be combined with any or all of a light source, fog generator, foam generator, fragrance diffuser, taste diffuser, pyrotechnic device, heater or air conditioner.

The speaker incorporated in the multisensory entertainment module may be any wired or wireless electroacoustic transducer that produces sound in response to an electrical audio signal input. The light source incorporated in the multisensory entertainment module may be a stroboscopic lamp, an LED lamp, floodlight, laser light source or any other source of high intensity artificial light. The laser light source incorporated in the multisensory entertainment module may be any light source capable of projecting a laser beam or a holographic laser display. The taste diffuser incorporated into the multisensory entertainment module may be any device capable of emanating an aerosol spray for stimulating the sense of taste. The fragrance diffuser incorporated into the multisensory entertainment module may be any device capable of emanating in aerosol spray capable of stimulating the sense of smell. The pyrotechnic device incorporate it in the multisensory entertainment module may be any device capable of producing self-contained and self-sustained exothermic reactions, including fireworks. The heating device incorporated in the multisensory entertainment module may include a gas powered heater, an electric powered heater, a solar powered heater, or any other device capable of producing the sensation of heat the members of the audience. The air-conditioning device incorporated in the multisensory entertainment module may include a gas powered air conditioner, and electric air conditioner, a solar powered air conditioner or any device capable of creating the sensation of cooling in the members of the audience.

In one embodiment, the multisensory entertainment modules are attached to the structure so that each member of the audience is located within a maximum optimal distance from a multisensory entertainment module (⌈). In this embodiment, each member of the audience in the entertainment venue receives sensory stimulation of similar quality to every other member of the audience. The maximum optimal distance from a multisensory entertainment module (⌈) permitted in this embodiment of the invention can be calculated with the following equation:

$$\lceil = \sqrt{\tfrac{1}{4}(b^2+a^2)}$$

where "a" is the distance between consecutive multisensory entertainment modules along the y-axis and "b" is the distance between consecutive multisensory entertainment modules along the x-axis. In this embodiment of the invention, no member of the audience will experience the performance from a distance greater than the maximum optimal distance from a multisensory entertainment module (⌈). This permits each member of the audience to receive stimulation from the speakers, light sources, fog generators, foam generators, fragrance diffusers, taste diffusers, pyrotechnic devices, and heaters or air conditioners incorporated in one or more of the multisensory entertainment modules. This enhances the sensory experience of each member of the audience so that the audience members seated farther away from the stage experience sensory stimulation of similar quality to the audience members seated closer to the stage.

In another embodiment of the invention, the multisensory entertainment modules are attached to the structure in an array so as to evenly distribute sound pressure to the members of the audience. In this embodiment, each member of the audience experiences similar stimulation of his/her sense of sound. In this embodiment, the multisensory entertainment modules are distributed along the structure so that each member of the audience is exposed to sound pressure within 5 dB of the average sound pressure emitted by the multisensory entertainment modules. In other words, if the average sound pressure emitted by the multisensory entertainment modules is 85 dB, the individual members of the audience are exposed to sound pressure in an amount at least equal to 80 dB and at most 90 dB.

These and other features and advantages will be apparent from the following brief description of the drawings, detailed description, and appended claims and drawings.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present disclosure, examples of which are described herein and illustrated in the accompanying drawings. While the invention may be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
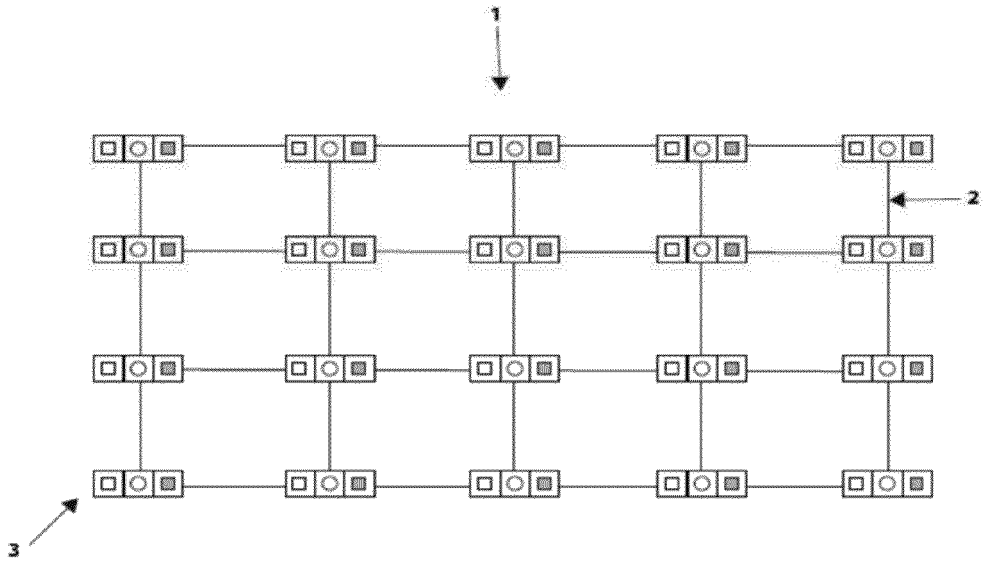
FIG. 1 illustrates an elevated view of the preferred embodiment.

FIG. 1 illustrates an elevated view of the preferred embodiment of the invention. The lattice structure 1 is shown extending over the audience members within the entertainment venue. The lattice structure may optionally be constructed so that it extends from the ground over the audience. In the preferred embodiment, the lattice structure is constructed so that it forms the shape of a grid over the audience. The lattice structure in this embodiment is further constructed so that the structural members 2 of the lattice are positioned to accommodate an array of multisensory entertainment modules 3 in a configuration that enhances the sensory stimulation of the audience members. In the preferred embodiments the configuration of the multisensory entertainment modules ensures that each audience member experiences the performance within a maximum optimal distance from one or more multisensory entertainment modules.

Figure 2:
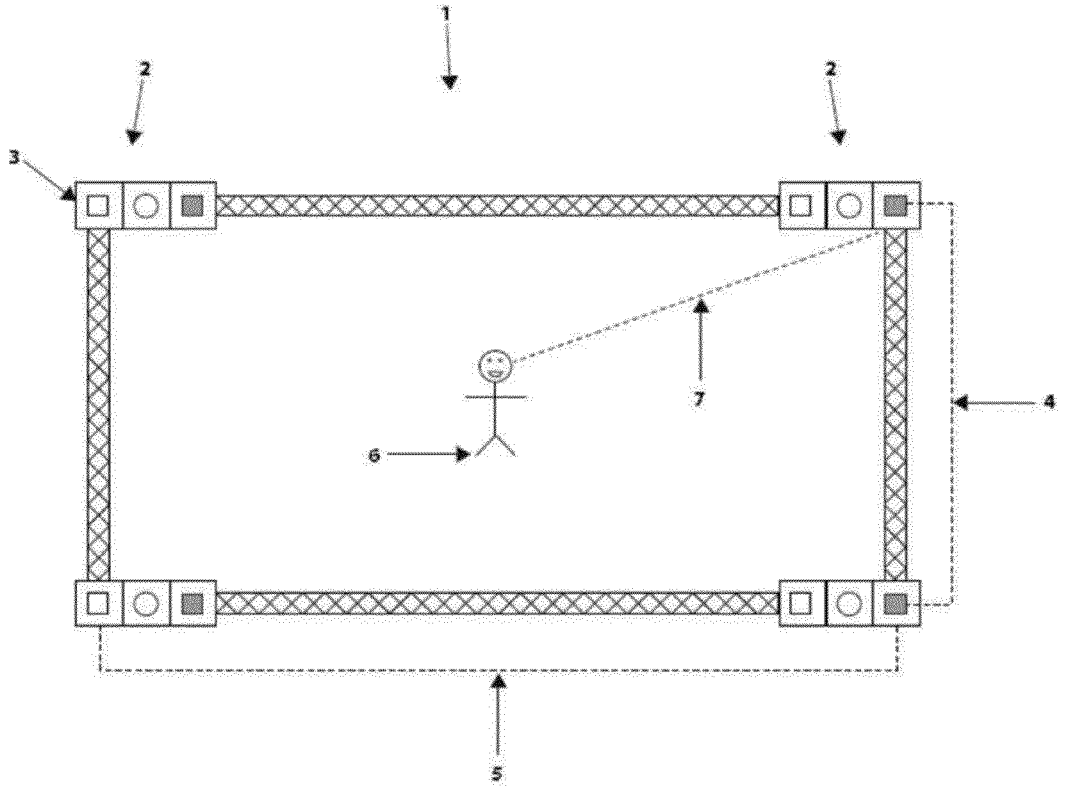
FIG. 2 illustrates the maximum optimum distance of an audience member from a multisensory entertainment module.

Referring to FIG. 2, a portion of the grid shape 1 formed by the structure of the preferred embodiment is shown. At each of the four corners 2 that comprises the portion of the grid shape a multisensory entertainment module 3 is attached to the structure. The distance between multisensory entertainment modules along the y-axis 4 and the distance between multisensory entertainment modules along the x-axis 5 is such that each audience member experiencing the performance 6 is positioned within a maximum optimal distance 7 from one or more multisensory entertainment modules.

Figure 3:
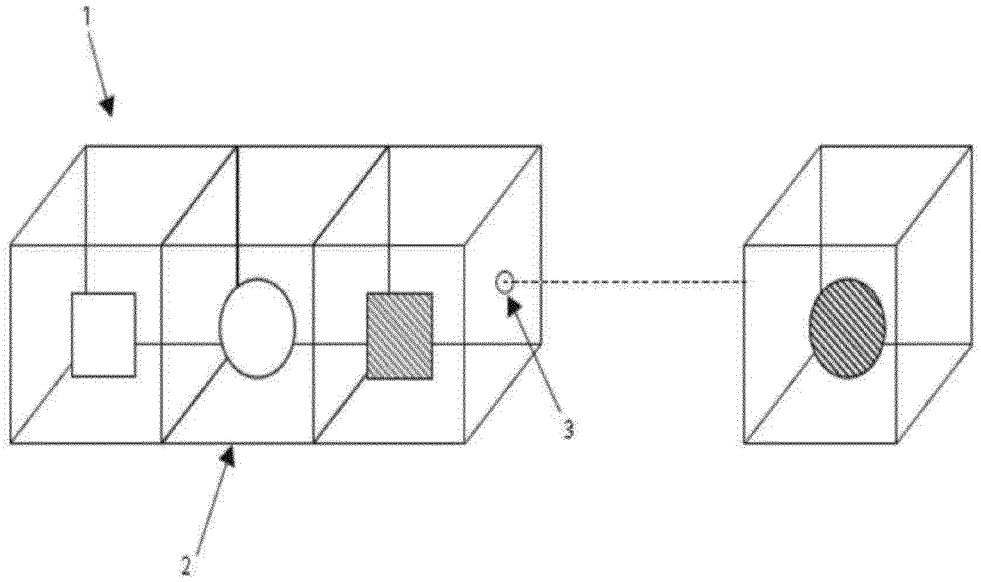
FIG. 3 illustrates an example of a multisensory entertainment module.

Referring to FIG. 3, a multisensory entertainment module 1 of the type used in the preferred embodiment is shown. The multisensory entertainment module includes a plurality of sensory stimulation devices 2 that are capable of stimulating one or more of the senses of sound, sight, smell, taste, or touch of the members of the audience. In the preferred embodiment, one sensory stimulating device 2 included in the multisensory entertainment module is a speaker. The speaker in the multisensory entertainment module is attached to one or more of a light source, fog generator, foam generator, fragrance diffuser, taste diffuser, pyrotechnic device, heater or air conditioner. Furthermore, the multisensory entertainment module of the preferred embodiment may incorporate the sensory stimulating devices within a fixed housing or a multitude of attachable housings that permit the interchanging of sensory stimulating devices to provide a multisensory entertainment module with the desired components. The attachable housings may be attached by one or more fasteners 3 to configure a multisensory entertainment module with the desired components.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. An apparatus for enhancing the experience of one or more attendees at an entertainment event so that each attendee's senses are stimulated comprising:

a lattice grid structure;

three or more first multi-sensory entertainment modules spaced apart from each other and coupled to the lattice grid structure at a first location and defining a first perimeter configuration of the first modules, wherein the first modules are configured to emit a sensory output within a first zone;

three or more second multi-sensory entertainment modules spaced apart from each other and coupled to the lattice grid structure at a second location and defining a second perimeter configuration of the second modules, wherein the second modules are configured to emit the sensory output within a second zone;

wherein the spacing between the first modules and orientation of the first modules in the first configuration is the same with respect to the spacing between the second modules and orientation of the second modules in the second configuration; and wherein the first zone and second zone spatial area dimensions are the same with respect to each other; and wherein the first and second configurations of the first and second modules are configured above or around the attendees in a horizontal plane, and wherein the magnitude of the sensory output within the first zone is the same as that of the second zone.

2. The apparatus of claim 1 wherein the grid structure is capable of sustaining an array of multisensory entertainment modules.

3. The apparatus of claim 1 wherein the first and second multisensory entertainment modules are positioned so that each attendee is within a maximum optimal distance from either the first or second modules.

4. The apparatus of claim 1 wherein the first and second multisensory entertainment modules are positioned so that each attendee is exposed to sound pressure in an amount within 5 dB above or below the average sound pressure emitted by the first and second multisensory entertainment modules.

5. The apparatus of claim 1 wherein the first and second multisensory entertainment modules include a speaker and one or more additional sensory stimulating devices.

* * * * *